US006530299B1

(12) United States Patent
Liu

(10) Patent No.: US 6,530,299 B1
(45) Date of Patent: Mar. 11, 2003

(54) JOINT ADAPTER FOR A POWER DRILL SCREW DRIVER

(76) Inventor: Tsai-Fa Liu, No. 88, Lane 412, Chen Hsing Rd., Taichung 401 (TW)

( * ) Notice: Subject to any disclaimer, the term of this patent is extended or adjusted under 35 U.S.C. 154(b) by 0 days.

(21) Appl. No.: 09/988,503

(22) Filed: Nov. 20, 2001

(51) Int. Cl.[7] ..... B25B 23/12
(52) U.S. Cl. ..... 81/451; 81/125
(58) Field of Search ..... 81/451, 900, 125, 81/429, 438

(56) References Cited

U.S. PATENT DOCUMENTS 3,392,767 A * 7/1968 Stillwagon, Jr. ..... 81/451
5,996,452 A * 12/1999 Chiang ..... 81/451

* cited by examiner

*Primary Examiner*—D. S. Meislin
(74) *Attorney, Agent, or Firm*—Troxell Law Office PLLC; Kuo-Hsiung Chiu

(57) ABSTRACT

The present invention relates to a joint adapter for a power drill screw driver having a driving shaft, a slide socket, a compression spring, a packing ring and a screw driver bit. The driving shaft is provided with an insertion groove and an insertion piece. A neck is located in the middle of the driving shaft. A strong magnet is fixed at the front end of the axial insertion hole. A clamping ring is arranged at a proper place of the axial insertion hole. The compression spring is inserted around the neck of the driving shaft and rests on the clamping ring of the slide socket. The packing ring closely sits at the end of the neck of the driving shaft in a tight state while the compression spring presses against the packing ring so that the compression spring and the slide socket are located in place. A plurality of screw driver bits in a plurality of shapes and sizes each being selectively inserted into the insertion groove of the driving shaft for tightening the screws.

1 Claim, 4 Drawing Sheets

JOINT ADAPTER FOR A POWER DRILL SCREW DRIVER

BACKGROUND OF THE INVENTION

1. Field of the Invention

The present invention relates to a joint adapter for a power drill screwdriver, and more particularly, to a joint adapter which can be used more easily and conveniently for a rapid exchange of the screw driver bits.

2. Description of the Prior Art

The joint adapter 10 for a (either electric or pneumatic) conventional power drill screw driver, as shown in FIG. 5, includes a driving shaft 12 with an insertion groove 11, a locating socket 14 with female thread 13, a washer 15 and an adjustable shell 17 with axial threaded internal hole 16. The driving shaft 12 is provided with male thread 18 within a certain range on which the locating socket 14 and the adjustable shell 17 are screwed one after the other. The washer 15 is interposed between the locating socket 14 and the adjustable shell 17 for strengthening the fixing effect and for avoidance of unexpected loosening.

In using, after the insertion piece 19 of the driving shaft 12 is inserted into a corresponding insertion groove of the power drill screw driver (not shown), the locating socket 14 and the adjustable shell 17 are screwed in the direction of the screw driver bit 20 for a certain distance. Meanwhile, a strong magnet 22 at the front end of the axial threaded internal hole 16 of the adjustable shell 17 approaches the screw driver bit 20 in order to attract the screw 24 in a stable state. Accordingly, the high speed screwing can be smoothly performed.

However, the above-mentioned joint adapter 10 has the following drawbacks:

1. The locating socket 14 and the adjustable shell 17 have to be respectively screwed to the expected positions due to the arrangement of the washer 15. Thus, the operational efficiency is greatly diminished.
2. As shown in FIG. 6, when the locating socket 14 and the adjustable shell 17 are screwed to the operation position of the screw 24, the screwing portion between the adjustable shell 17 and the driving shaft 12 is gradually reduced so that the adjustable shell 17 shakes or can become detached from the locating socket 14 and the driving shaft 12. Thus, difficulties in positioning and operation are experienced.
3. As shown in FIG. 7, in order to exchange the (slotted, Phillips, hexagonal and differently sized) screw driver bits 20, the locating socket 14 and the adjustable shell 17 have to be screwed to the bottom to let the screw drier bit 20 project more. Therefore, the operator can pull out the screw driver bit 20 more easily. After completing the exchange work, the operator has to screw the locating socket 14 and the adjustable shell 17 back to the operational position, thereby causing much inconvenience.

SUMMARY OF THE INVENTION

It is a primary object of the present invention to remove the above-mentioned drawbacks and to provide a joint adapter for a power drill screw driver which makes use of a sliding element and a resilient element to easily and rapidly complete the screwing work (including attaching the screw and exchanging a plurality of screw driver bits in a plurality of types and sizes) in order to enhance the operational efficiency and to meet the convenient and practical requirements.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
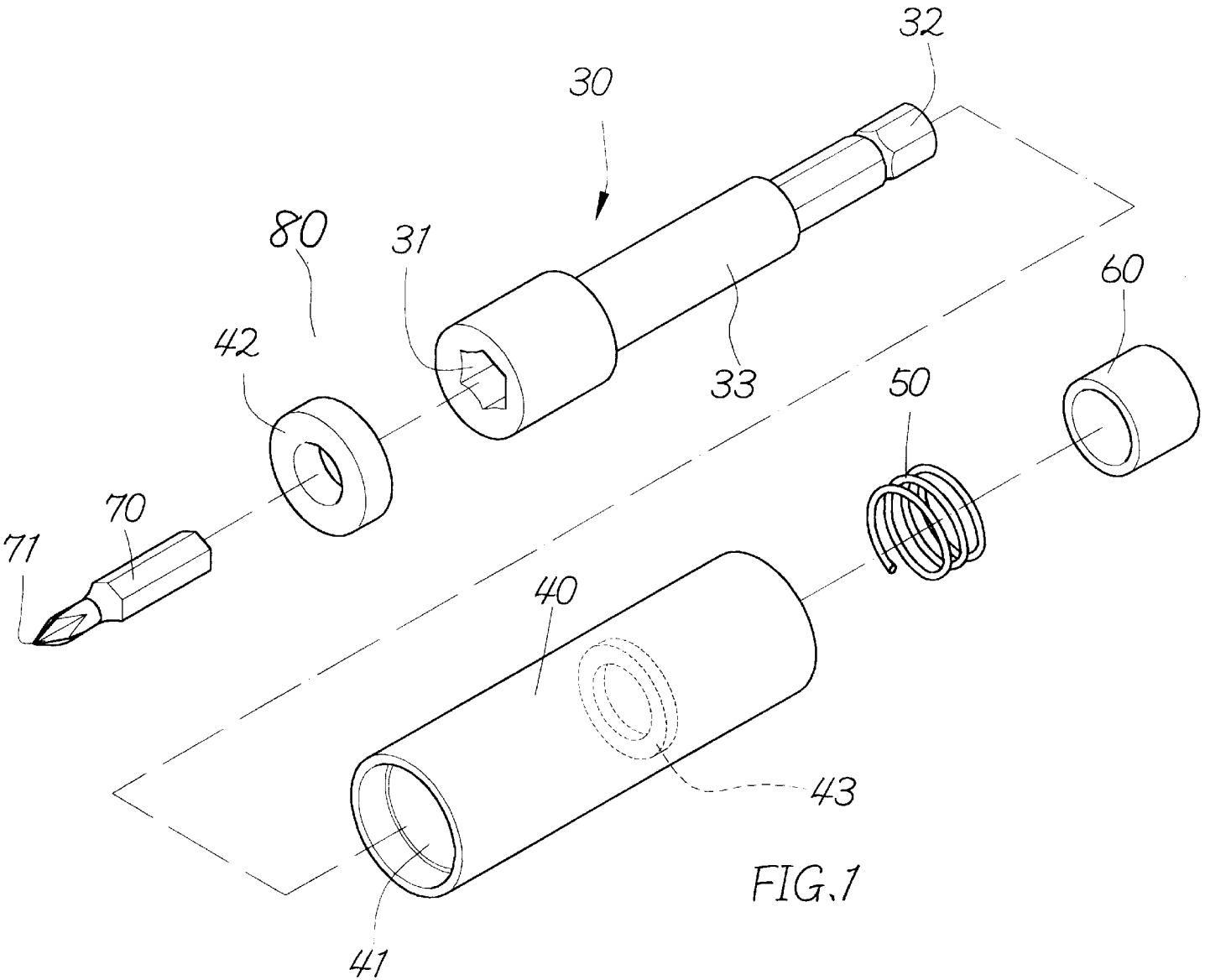
FIG. 1 is a perspective exploded view of a preferred embodiment of the present invention.
Figure 2:
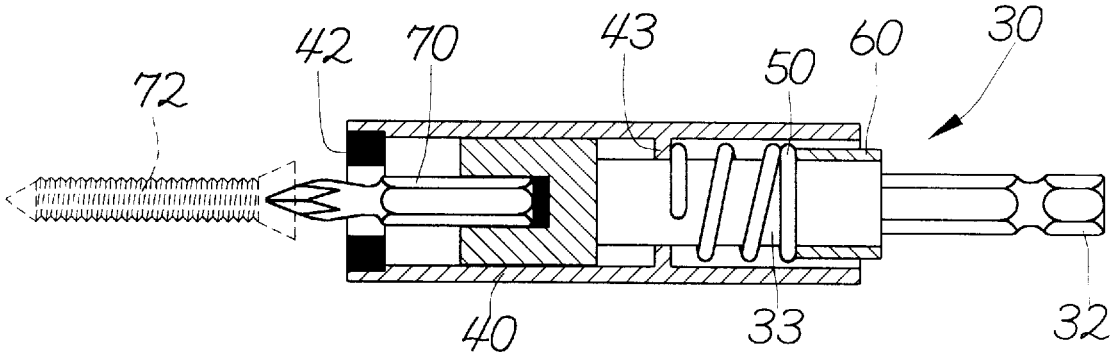
FIG. 2 is a longitudinally sectional view of FIG. 1 after assembly.
Figure 3:
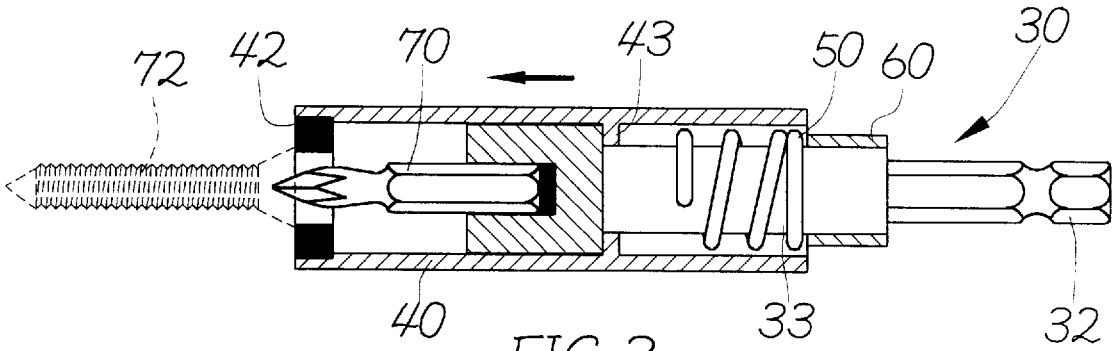
FIG. 3 is a schematic drawing of the operation of FIG. 1 after assembly.

First of all, referring to FIGS. 1 and 2, the joint adapter 80 for a power drill screw driver in accordance with the present invention includes a driving shaft 30, a slide socket 40, a compression spring 50, a packing ring 60 and a screw driver bit 70. The driving shaft 30 is provided with an insertion groove 31 and an insertion piece 32 at each end, respectively. A neck 33 is located in the middle of the driving shaft 30. The slide socket 40 with an axial insertion hole 41 surrounds the driving shaft 30. A strong magnet 42 is fixed at the front end of the axial insertion hole 41. A clamping ring 43 is arranged at a proper place of the axial insertion hole 41. The compression spring 50 is inserted around the neck 33 of the driving shaft 30 and rests on the clamping ring 43 of the slide socket 40. The packing ring 60 sits closely at the end of the neck 33 of the driving shaft 30 in a tight state while the compression spring 50 and the slide socket 40 are located in place. The screw driver bit 70 in a plurality of shapes and sizes is inserted into the insertion groove 31 of the driving shaft 30 for tightening the screws 72.

Based on the assembly of the above-mentioned components, a contact tip 71 of the screw driver bit 70 is inserted in the head of the screw 72 so that the slide socket 40 pops forward to be attached with the screw 72 because of the attraction power of the strong magnet 42. Accordingly, a high-speed rotation of the power drill screwdriver can be performed without expected detachment.

Figure 4:
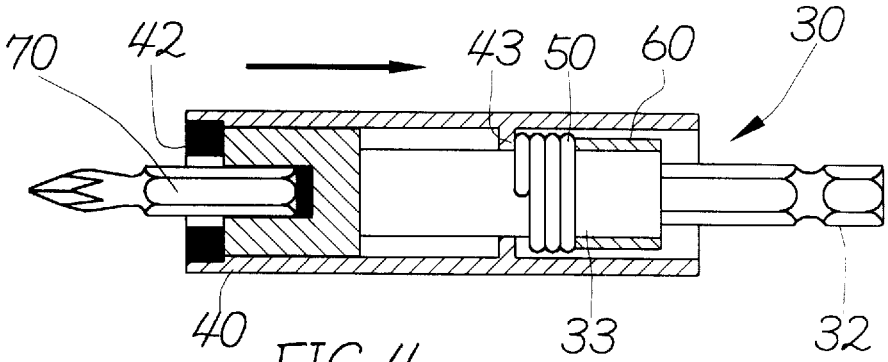
FIG. 4 is another schematic drawing of the operation of FIG. 1 after assembly.
Figure 5:
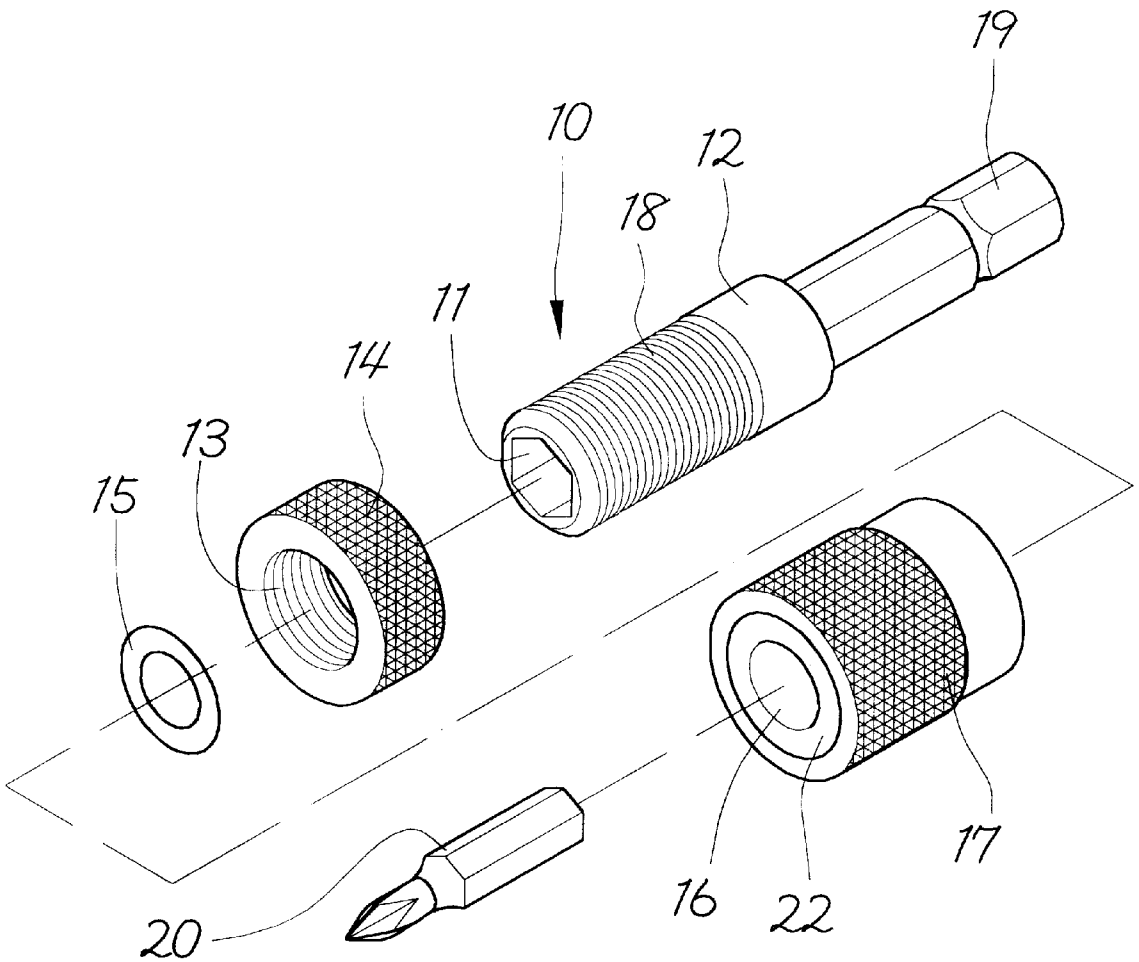
FIG. 5 PRIOR ART
FIG. 5 is a perspective exploded view of a conventional joint adapter for a power drill screw driver.
Figure 6:
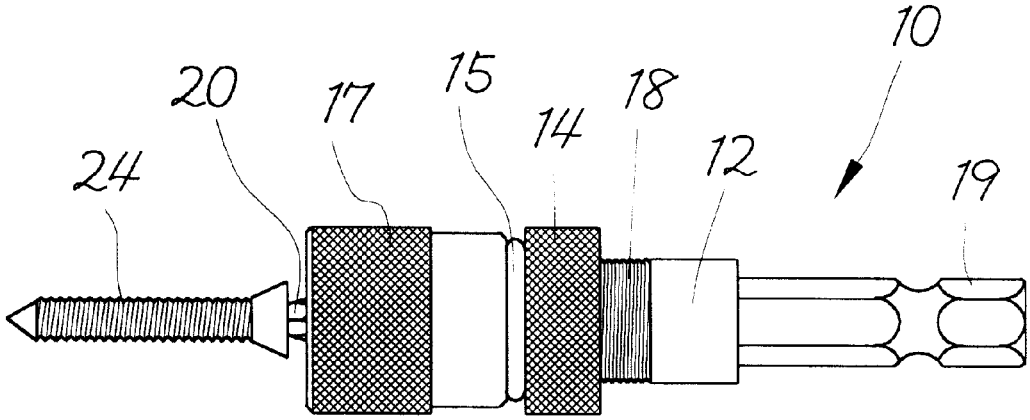
FIG.6 PRIOR ART
FIG. 6 is a side view of FIG. 5 after assembly.
Figure 7:
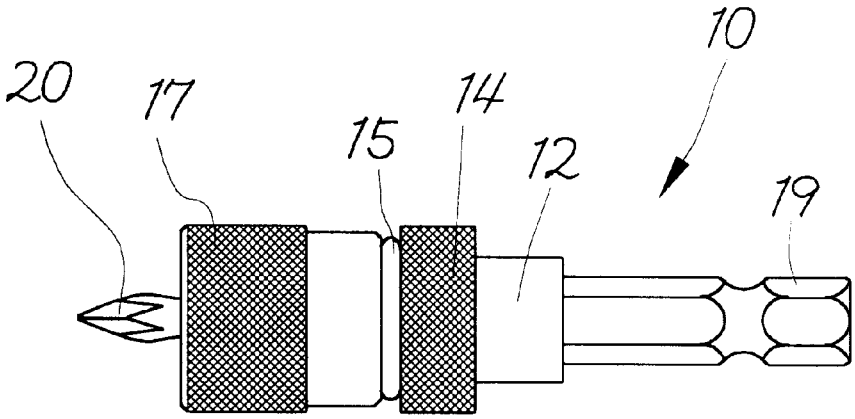
FIG.7 PRIOR ART
FIG. 7 is a schematic drawing of the operation of FIG. 5 after assembly.

In exchanging the screw driver bit 70, as shown in FIG. 4, it's only required to move the slide socket 40 in the direction of the insertion piece 32 of the driving shaft 30 to the bottom end. Therefore, the screwdriver bit 70 projects from the opening of the slide socket 40 in order for the user to hold it for rapid exchange.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. A joint adapter for a power drill screw driver comprising:

a) a driving shaft having an insertion groove at a first end, an insertion piece at a second end, and a neck located in a middle of said driving shaft, wherein the first end is larger in cross-section than the neck and second end;

b) a screw driver bit removably plugged into said insertion groove of said driving shaft, the screw driver bit having a contact tip;

c) a slide socket movably mounted on said driving shaft so as to surround the enlarged first end of the driving shaft, the slide socket having an axial insertion hole, a magnet fixed at a front end of said axial insertion hole and an inwardly extending clamping ring located so as to contact the larger cross-section first end thereby limiting movement of the slide socket relative to the driving shaft such that the contact tip always extends outwardly of the slide socket through the axial insertion hole;

d) a packing ring mounted on the neck of said driving shaft; and, e) a compression spring located around said neck of said driving shaft between the packing ring and the clamping ring of said slide socket.

* * * * *